US007651747B2

(12) United States Patent
Chen et al.

(10) Patent No.: US 7,651,747 B2
(45) Date of Patent: Jan. 26, 2010

(54) FUSIBLE INKJET MEDIA INCLUDING SOLID PLASTICIZER PARTICLES AND METHODS OF FORMING AND USING THE FUSIBLE INKJET MEDIA

(75) Inventors: Tienteh Chen, San Diego, CA (US); Radha Sen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/925,232

(22) Filed: Aug. 23, 2004

(65) Prior Publication Data

US 2006/0038871 A1 Feb. 23, 2006

(51) Int. Cl.
*B41M 5/50* (2006.01)

(52) U.S. Cl. ..... 428/32.25; 428/32.37

(58) Field of Classification Search ..... None
See application file for complete search history.

(56) References Cited

U.S. PATENT DOCUMENTS 4,554,235 A 11/1985 Adair et al.
4,902,577 A * 2/1990 Butters et al. ..... 428/32.1
5,320,897 A * 6/1994 Kondo et al. ..... 428/32.36
5,376,434 A 12/1994 Ogawa et al.
5,460,874 A * 10/1995 Rao ..... 428/32.23
5,478,631 A 12/1995 Kawano et al.
5,635,297 A 6/1997 Ogawa et al.
5,851,651 A * 12/1998 Chao ..... 428/327
6,028,029 A 2/2000 Takeuchi
6,177,187 B1 1/2001 Niemoller et al.
6,497,481 B1 * 12/2002 Landry-Coltrain et al. .. 347/106
6,635,319 B1 * 10/2003 Sunderrajan et al. ..... 428/32.15
6,652,928 B2 * 11/2003 Sato et al. ..... 428/32.12
2001/0028382 A1 10/2001 Ichinose
2003/0021962 A1 1/2003 Mukherjee et al.
2003/3138719 7/2003 Daininppon Co. LTD

FOREIGN PATENT DOCUMENTS

DE 10115782 10/2002
WO WO 00/54981 9/2000

* cited by examiner

*Primary Examiner*—Bruce H Hess

(57) ABSTRACT

A fusible print medium for use in inkjet printing. The fusible print medium includes a substrate and a fusible layer, the fusible layer comprising at least one organic pigment and at least one solid plasticizer. A method of producing the fusible print medium and a method of producing a photographic quality image are also disclosed.

40 Claims, 2 Drawing Sheets

FUSIBLE INKJET MEDIA INCLUDING SOLID PLASTICIZER PARTICLES AND METHODS OF FORMING AND USING THE FUSIBLE INKJET MEDIA

FIELD OF THE INVENTION

The present invention relates to a print medium for use in inkjet printing. More specifically, the present invention relates to a fusible print medium that utilizes solid plasticizer particles to improve fusing efficiency of the fusible print medium.

BACKGROUND OF THE INVENTION

The use of inkjet printing in offices and homes has grown dramatically in recent years. The growth can be attributed to drastic reductions in cost of inkjet printers and substantial improvements in print resolution and overall print quality. While the print quality has improved drastically, research and development efforts continue toward further improving the print quality to achieve images having photographic quality. A photographic quality image includes saturated colors, high gloss and gloss uniformity, freedom from grain and coalescence, and a high degree of permanence. To achieve photographic image quality, the print medium must be fast drying and resist smearing, air, light, and moisture. In addition, the print medium should provide good color fidelity and high image resolution.

In order to obtain printed images that dry quickly and have good image quality, durability, and permanence, microporous inkjet print media with thermally laminated barrier layers have been developed. While lamination of the printed image provides very good image quality and permanence, the cost of producing the laminated images is increased due to the cost of the laminator and the additional supplies that are necessary. In addition, lamination produces haze and air bubbles, which become trapped, decreasing the image quality of the printed images.

Print media that are capable of producing images having photographic image quality are typically categorized into two groups: porous media and swellable media. Porous media generally have an ink-receiving layer that is formed from porous, inorganic particles bound with a polymer binder. An inkjet ink is absorbed into the pores of the inorganic particles and the colorant is fixed by mordants incorporated in the ink-receiving layer or by the surface of the inorganic particles. Porous media have a short dry time and good resistance to smearing because the inkjet ink is easily absorbed into the pores of the ink-receiving layer. However, porous media do not exhibit good resistance to fade. In swellable media, the ink-receiving layer is a continuous layer of a swellable, polymer matrix. When the inkjet ink is applied, the inkjet ink is absorbed by swelling of the polymer matrix and the colorant is immobilized inside the continuous layer. Since the colorant is protected from the outside environment, swellable media have greater resistance to light and dark/air fade than the porous media. However, the swellable media generally have reduced smearfastness and a longer drytime than porous media.

To overcome the problems with porous and swellable media, fusible or sealable print media have been developed and continue to be researched. After a desired image is printed, the fusible print medium is exposed to heat and/or pressure to seal a fusible layer over the printed image. The sealed, fusible layer forms a protective film over the printed image, helping to protect the printed image from scratches or fading. While this printed image has a greater resistance to light and dark/air fade, the image is typically non-glossy and has a low gamut. The fusible layer is typically formed from a polymeric material that has a high glass transition temperature ("$T_g$"), such as a high $T_g$ latex. The polymeric material prevents the polymer from coalescing at ambient temperature and improves scratch resistance of the printed image. However, a large amount of energy is used to fuse the fusible layer. The amount of energy or heat required to fuse the fusible layer is referred to herein as a fusing energy. The fusible layer typically requires that a temperature of greater than approximately 90° C. is reached and maintained for 30 seconds or more to fuse the fusible layer. Since a long dwell time at an elevated temperature is required, printing throughput on the fusible print medium is low and is limited by the print speed of the inkjet printer. As such, the fusible print medium is used with a slow inkjet printer or a slow inkjet print mode. Therefore, fusible print media typically have a low fusing efficiency. As used herein, the term "fusing efficiency" refers to an amount of time that is used to fuse the fusible layer of the fusible print medium. If less time is needed to fuse the fusible layer, throughput is increased.

To improve the fusing efficiency of fusible print medium, low $T_g$ polymers have been incorporated into the fusible layer. However, the low $T_g$ polymers are problematic because the fusible print medium may be prematurely fused, which damages print quality and image quality. The surface of the fusible print medium is also more prone to scratch damage. Infrared absorbers have also been included in the fusible layer to improve the fusing efficiency. However, the infrared absorbers require radiative heat to become activated and, therefore, are not practical for home use. In addition, the infrared absorbers are expensive, are soluble in solvents, and impart a color to the fusible layer. Liquid plasticizers have also been added to inkjet inks to improve the fusing efficiency of fusible print medium. Since the liquid plasticizer is a component of the inkjet ink, it passes through the fusible layer with the inkjet ink. Therefore, the liquid plasticizer does not remain in contact with the fusible layer for a sufficient amount of time to aid the fusing of the fusible print medium.

BRIEF SUMMARY OF THE INVENTION

The present invention relates to a fusible print medium for use in inkjet printing. The fusible print medium comprises a substrate and a fusible layer. The fusible layer comprises at least one organic pigment and at least one solid plasticizer.

The present invention also relates to a method of producing the fusible print medium. The method comprises providing a substrate and forming a fusible layer on the substrate. Forming the fusible layer on the substrate comprises coating a formulation of the fusible layer on the substrate. The fusible layer comprises at least one organic pigment and at least one solid plasticizer.

The present invention also relates to a method of producing a photographic quality image. The method comprises providing a fusible print medium comprising a substrate and a fusible layer, which comprises at least one organic pigment and at least one solid plasticizer.

BRIEF DESCRIPTION OF THE SEVERAL VIEWS OF THE DRAWINGS

While the specification concludes with claims particularly pointing out and distinctly claiming that which is regarded as the present invention, the advantages of this invention can be more readily ascertained from the following description of the invention when read in conjunction with the accompanying drawings in which:

DETAILED DESCRIPTION OF THE INVENTION

Figure 1:
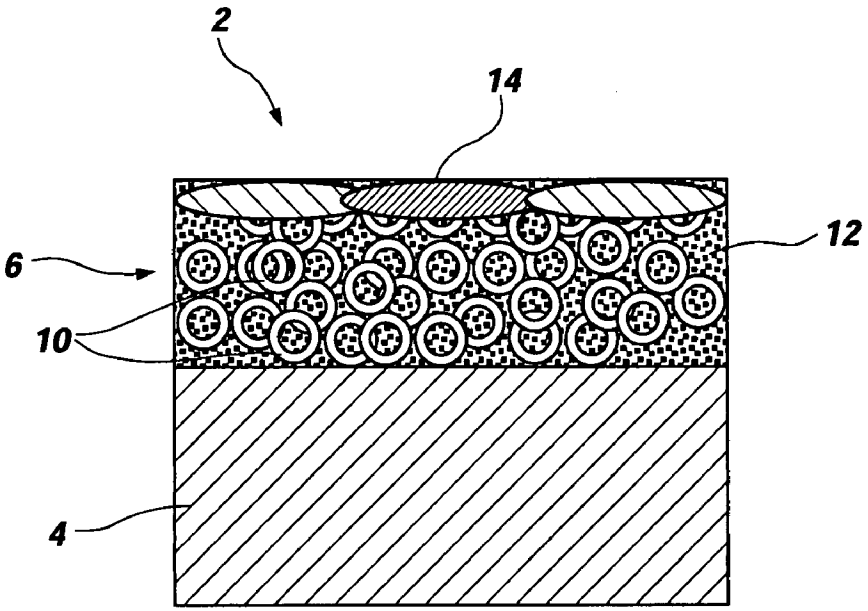
FIG. 1 is a schematic illustration of an embodiment of a fusible print medium having a fusible layer of the present invention.
Figure 2:
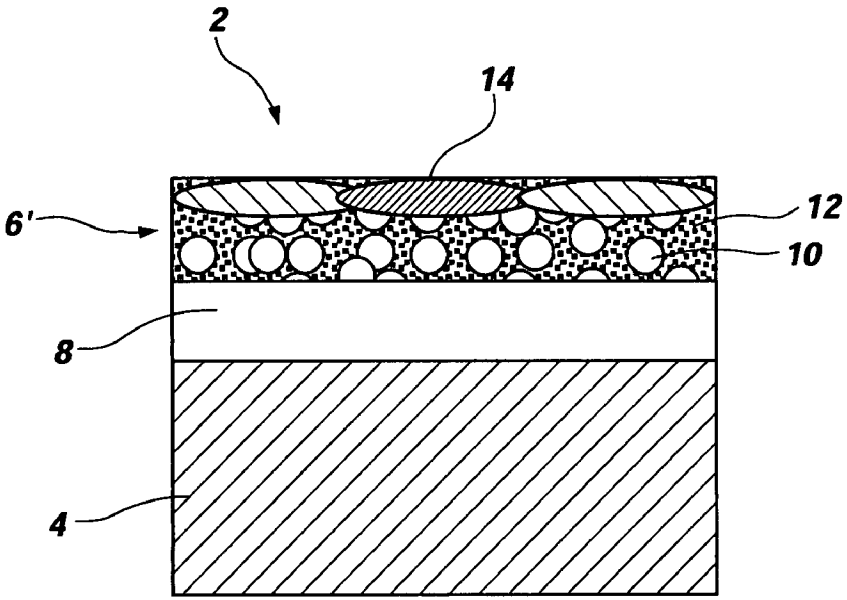
FIG. 2 is a schematic illustration of an embodiment of a fusible print medium having a fusible layer of the present invention.

A fusible print medium for use in inkjet printing is disclosed. As used herein, the term "fusible print medium" refers to an inkjet recording material having a fusible top coating or a fusible layer. The fusible print medium may include at least one organic pigment and at least one solid plasticizer. The solid plasticizer improves a fusing efficiency and image quality of an image printed on the fusible print medium. The fusible print medium 2 may include a substrate 4 and a fusible layer 6, as shown in FIG. 1 (not drawn to scale). Alternatively, the fusible print medium 2 may include a substrate 4, an ink-receiving layer 8, and a fusible layer 6', as shown in FIG. 2 (not drawn to scale).

The substrate 4 may be a conventional photobase or filmbase formed from a transparent, opaque, or translucent material that provides support to overlying layers as the fusible print medium 2 is transported through an inkjet printer. The substrate 4 may include a hard or flexible material made from a polymer, a paper, a glass, a ceramic, a woven cloth, or a non-woven cloth material. Polymers that may be used in the substrate 4 include, but are not limited to, polyesters, cellulose esters, polyurethanes, polyester-ethers, polyester ketones, vinyl polymers, polystyrene, polyethylene terephthalate, polysulfones, polybutylene terephthalate, polypropylene, methacrylates, diallyl phthalates, cellophane, acetates, cellulose diacetate, cellulose triacetate, celluloid, polyvinyl chloride, polyvinyl acetate, polycarbonates, and mixtures thereof. The substrate 4 may be from about 2 mm to about 12 mm thick, depending on a desired end application for the fusible print medium 2.

In one embodiment, the fusible layer 6 functions as an ink-receiving layer. As such, the fusible layer 6 is formulated to receive inkjet ink. The fusible layer 6 may include the organic pigment 10 and the solid plasticizer 12, which are present in the fusible layer 6 as particles. The particles of the organic pigment 10 may be porous so that the inkjet ink is capable of penetrating into the fusible print medium 2. The organic pigment 10 may be a thermoplastic polymer having a high $T_g$, such as a $T_g$ greater than approximately 40° C. The organic pigment 10 may be a solid plastic pigment, such as a polymer latex or a polymer bead with a $T_g$ greater than approximately 40° C. As used herein, the term "solid plastic pigment" refers to a plastic pigment that does not include pores or voids. The organic pigment 10 may have an average particle size ranging from approximately 0.2 μm to approximately 10 μm.

Examples of solid plastic pigments include, but are not limited to, synthetic latexes, such as acrylic, styrene acrylic, ethylene vinylacetate, vinyl-acrylate, styrene, polyurethane, polyester, low density polyethylene ("LDPE") beads, polystyrene beads, polymethylmethacrylate ("PMMA") beads, and polyester particles. Examples of the solid plastic pigments include, but are not limited to, those that are available under the following trademarks: AIRFLEX (Air Products); ALBERDINGK (Alberdingk Boley, Inc.); ACRONAL OPTIVE (BASF Architectural Coatings); NEOCAR acrylic UCAR latex, and UCAR vehicle (Dow Union Carbide Chemical Company); JONCRYL (Johnson Polymers); ARMOREZ, JONREZ, and SYNPAQUE (MeadWestvaco); NEOCRYL (NeoResins); CARBOSET (Noveon); POLYCHEM (OPC Polymers); AROLON, SYNTHEMUL, and WALLPOL. (Reichhold Chemicals); TEXIGEL (Scott Bader); SETALUX (Akzo Nobel); RHOPLEX and POLYCO (Rohm Haas Chemical), ROVENE (Mallard Creek Polymers, Inc.), EASTMAN AQ (Eastman Chemical Company); and WITCOBOND (Witco Chemicals). In one embodiment, the organic pigment 10 is DOW PB6656A, DOW 6688A, DOW 722HS, DOW 756A, or DOW 788A, which are available from DOW Chemical Company.

Alternatively, the organic pigment 10 may be a hollow plastic pigment. While hollow plastic pigments are illustrated in FIG. 1, it is understood that the fusible print medium 2 may include solid plastic pigments as previously described. The particles of the hollow plastic pigment may have a void volume ranging from approximately 10% to approximately 90%. Examples of hollow plastic pigments include, but are not limited to, an acrylic or styrene acrylic emulsion, such as ROPAQUE HP-543, ROPAQUE HP-643, ROPAQUE HP-1055, or ROPAQUE OP-96 (available from Rohm and Haas Co. (Philadelphia, Pa.)) or DOW HS 2000NA, DOW 3000NA, DOW 3020NA, or DOW 3042NA (available from Dow Chemical Co. (Midland, Mich.)).

The solid plasticizer 12 may be a compound that is capable of plasticizing the organic pigment 10 and that is compatible with the organic pigment 10. The solid plasticizer 12 may be a solid at a temperature of less than approximately 40° C. and may have a melting point greater than approximately 40° C. As such, the solid plasticizer 12 is a solid at room temperature and at temperatures up to approximately 40° C. The melting point of the solid plasticizer 12 may be lower than the $T_g$ of the organic pigment 10. An average molecular weight of the solid plasticizer 12 may range from approximately 200 to approximately 2000. By utilizing a plasticizer that is a solid at room temperature, the solid plasticizer 12 remains homogenously distributed in the fusible layer 6,6' and does not migrate to other layers of the fusible print medium 2.

To prevent the fusible print medium 2 from prematurely fusing (i.e., before the desired image is printed), the melting point of the solid plasticizer 12 may be higher than a maximum temperature to which the fusible print medium 2 is exposed for extended periods during shipping or storage. The melting point of the solid plasticizer may range from greater than approximately 40° C. to approximately 150° C. For instance, the melting point of the solid plasticizer may range from greater than approximately 70° C. to approximately 150° C. In one embodiment, the melting point of the solid plasticizer 12 is below approximately 90° C. so that the fusing conditions used to seal the fusible layer 6 are practical and do not add additional expense to the cost of sealing the printed images.

Solid plasticizers 12 are known in the art and may include a phthalate compound, a terephthalate compound, an isophthalate compound, a benzoate compound, a polymeric adipate compound, or mixtures thereof. Examples of the solid plasticizer 12 include, but are not limited to, sucrose benzoate, 1,4-cyclohexanedimethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, dihexyl phthalate, diactyl phthalate, cumylphenyl isophthalate, dihydroabietyl phthalate, dimethyl isophthalate, ethylene glycol dibenzoate, trimethylolethane tribenzoate, pentaerythritol tetrabenzoate, sucrose octaacetate, tricyclohexyl citrate, N-cyclohexyl-p-toluenesulfonamide, o,p-toluenesulfonamide, N-ethyl-p-toluenesulfonamide, N-butyl-p-toluenesulfonamide, n-tallow-4-toluenesulfonamide, p-toluenesulfonamide-formaldehyde resin, 1,2-di-(3-methylphenoxy)ethane, or mixtures thereof. The solid plasticizer 12 may have an average particle size of less than approximately 5 μm, such as less than approximately 0.5 μm.

In one embodiment, the solid plasticizer 12 is sucrose benzoate, 1,4-cyclohexanedimethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, o,p-toluenesulfonamide, N-cyclohexyl-p-toluenesulfonamide, 1,2-di-(3-methylphenoxy) ethane, or mixtures thereof.

The fusible layer 6 may also include at least one binder. The binder may be a water-soluble or water-dispersible polymer including, but not limited to, polyvinyl alcohol or derivatives thereof; a synthetic latex having a $T_g$ lower than approximately 30° C., such as styrene acrylic, acrylic, vinyl acrylic, styrene butadiene; vinyl acetate homo- or co-polymers; ethylene or vinyl chloride copolymers, polyurethane having a $T_g$ lower than approximately 30° C.; polyvinylpyrrolidone, starch or derivatives thereof, gelatin or derivatives thereof, cellulose or derivatives thereof (such as cellulose ethers, carboxymethyl cellulose, hydroxyethyl cellulose, or hydroxypropylmethyl cellulose), maleic anhydride polymers or copolymers thereof, acrylic ester copolymers, polyacrylamide, casein, and water- or ammonia-soluble polyacrylates or polymethacrylates and copolymers thereof. Specific examples of binders include, but are not limited to, polymers sold under the trademarks ROVENE (Mallard Creek Polymers, Inc.), UCAR (Dow Union Carbide Chemical Company), NEOREZ (available from NeoResins (Waalwijk, the Netherlands), RHOPLEX (Rohm Haas Chemical) and AIRFLEX (Air Products). In addition, mixtures of these binders may be used in the fusible layer 6.

The fusible layer 6 may include from approximately 50 weight percent ("wt %") to approximately 95 wt % of the organic pigment 10, from approximately 2 wt % to approximately 20 wt % of a dispersion of the solid plasticizer 12, and from approximately 1 wt % to approximately 20 wt % of the binder.

In another embodiment, the fusible layer 6' is a surface layer or coating that is formed over the ink-receiving layer 8. The ink-receiving layer 8 may be a microporous layer that includes microporous, inorganic particles having a large surface area. The microporous, inorganic particles may be bound in a polymer binder to form the ink-receiving layer 8. The microporous, inorganic particles may include, but are not limited to, silica, silica-magnesia, silicic acid, sodium silicate, magnesium silicate, calcium silicate, alumina, alumina hydrate, barium sulfate, calcium sulfate, calcium carbonate, magnesium carbonate, magnesium oxide, kaolin, talc, titania, titanium oxide, zinc oxide, tin oxide, zinc carbonate, pseudoboehmite, bentonite, hectorite, clay, and mixtures thereof. The ink-receiving layer 8 may be from approximately 1 μm to approximately 300 μm thick.

The fusible layer 6' may include at least one organic pigment 10 and the solid plasticizer 12. Both the organic pigment 10 and the solid plasticizer 12 may be present in the fusible layer 6' as particles. The organic pigment 10 may include at least one thermoplastic polymer, such as a synthetic latex. In this embodiment, the organic pigment 10 is a solid plastic pigment, such as a cationic latex, an anionic latex, or a non-ionic latex. The organic pigment 10 may include, but is not limited to, acrylic, styrene acrylic, ethylene vinylacetate, vinyl-acrylate, styrene, polyurethane, and polyester. The syntheticlatex may have a $T_g$ of greater than approximately 40° C. and an average particle size ranging from approximately 0.05 .mu.m to approximately 0.3 μm. Examples of the synthetic latex include, but are not limited to, cationic, anionic, or non-ionic acrylic or styrene acrylic emulsions, such as RHOPLEX B88 and RHOPLEX GL-603 (available from Rohm and Haas Co.), ROVENE 4106 and 4151 (available from Mallard Creek Polymers, Inc.), JONCRYL 1908 and 530 (available from Johnson Polymers), NEOCRYL A550 (available from Neoresins (Waalwijk, The Netherlands)), and DOW LDPE 756A or DOW LDPE 722A (available from Dow Chemical Co.).

The solid plasticizer 12 in the fusible layer 6' may include one of the solid plasticizers previously described. However, the solid plasticizer 12 used in the fusible layer 6' may have an average particle size of less than approximately 1 μm, such as less than approximately 0.2 μm. The fusible layer 6' may also include at least one binder, as previously described.

The fusible layer 6' may include from approximately 50 wt % to approximately 95 wt % of the organic pigment 10, from approximately 2 wt % to approximately 20 wt % of a dispersion of the solid plasticizer 12, and from approximately 1 wt % to approximately 20 wt % of the binder. The fusible layer 6' may have a thickness ranging from approximately 0.2 μm to approximately 10 μm.

The fusible layer 6,6' may optionally include surfactants, pH adjusting agents, inorganic pigments, plasticizers, thickeners, and/or lubricants depending on a desired end application of the fusible print medium 2.

To produce the fusible print medium 2, a coating formulation of the fusible layer 6 may be formed by mixing the organic pigment 10, the binder, and a dispersion of the solid plasticizer 12 with agitation. The dispersion of the solid plasticizer may be prepared by grinding the solid plasticizer 12 with wetting agents and dispersants to achieve the desired particle size. Conventional wetting agents and dispersants may be used and may be selected by one of ordinary skill in the art. For sake of example only, the solid plasticizer 12 may be dispersed in water.

The coating formulation of the fusible layer 6 may then be diluted and applied to the substrate 4 using conventional coating techniques. For example, the coating formulation may be applied using a roll coater, air knife coater, blade coater, bar coater, gravure coater, rod coater, curtain coater, slot coater, cascade coater, die coater, or air brush. The coating formulation may be applied to the substrate 4 at a coatweight ranging from approximately 10 grams per square meter ("GSM") to approximately 50 GSM. In one embodiment, the coatweight ranges from approximately 20 GSM to approximately 30 GSM. The coating formulation may then be dried on the substrate 4 at a temperature less than the melting point or $T_g$ of the organic pigment 10, the solid plasticizer 12, or the binder.

A coating formulation of the fusible layer 6' may be formed in a similar manner. For instance, the synthetic latex, the binder, and the solid plasticizer dispersion may be mixed with agitation as previously described. The coating formulation may then be diluted and applied to the ink-receiving layer 8 using conventional coating techniques, such as those previously described. The coating formulation may be applied to the ink-receiving layer 8 at a coatweight ranging from approximately 0.2 GSM to approximately 10 GSM. The coating formulation may then be dried on the substrate 4 at a temperature less than the melting point or $T_g$ of the synthetic latex, the binder, or the solid plasticizer 12.

The fusible print medium 2 may be used in an inkjet printing process to print photographic-quality images. The images may have high image gloss and good color gamut. The inkjet printing process may utilize a conventional inkjet printer and conventional inkjet inks to produce the printed image. The inkjet ink may be a black or color inkjet ink that includes a dye or a pigment as the colorant. The inkjet ink 14 may optionally include surfactants, pH adjusting agents, biocides, and/or other conventional additives, depending on the desired properties of the inkjet ink 14. The inkjet ink may be deposited on the fusible print medium 2 to produce the printed image.

In one embodiment, a pigment-based inkjet ink is deposited on the fusible layer 6 to print the desired image. The pigment-based inkjet ink may penetrate into the fusible layer 6, which is subsequently fused, as described below, to produce the photographic quality, printed image. In another embodiment, a dye-based inkjet ink is applied to the fusible layer 6'. The dye-based inkjet ink 14 may penetrate through the fusible layer 6' and into the ink-receiving layer 8 to produce the printed image having photographic quality. As described below, once the fusible print medium 2 is fused, the fusible layer 6' may form a thin layer or coating over the ink-receiving layer 8.

When the printed image has dried, the fusible print medium 2 may be exposed to heat of a sufficient temperature to fuse the fusible layer 6,6'. The fusible layer 6,6' may be fused by exposing the fusible print medium 2 to a temperature greater than the melting point of the solid plasticizer 12. The heat used to fuse fusible layer 6,6' may include contact heating or non-contact (radiant) heating. For instance, a heat source, such as a drying oven, an infrared ("IR") oven, a heat lamp, an IR lamp, a hot press, a laminator, or an iron, may be used to fuse the fusible print medium 2. The fusible layer 6,6' may also be fused using pressure, such as the pressure provided by pressure rollers in a fuser, photocopier, or hot laminator apparatus. In addition, the fusible layer 6,6' may be fused by exposing the fusible print medium 2 to a combination of heat and pressure, such as by using heated rollers in a fuser, photocopier, or hot laminator apparatus.

The fusing conditions (heat, pressure, or a combination thereof) may be selected based on the melting point of the solid plasticizer 12, the $T_g$ of the organic pigment, and/or the thickness of the fusible layer 6,6'.

Figure 3:
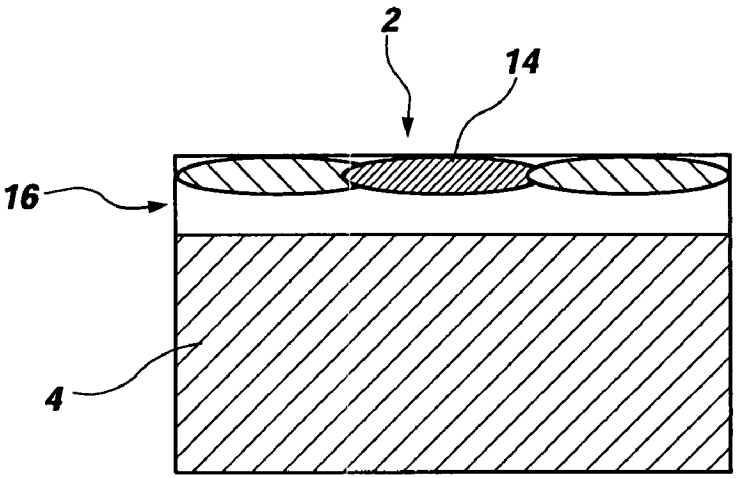
FIG. 3 is a schematic illustration of an embodiment of a fusible print medium having a fused layer.
Figure 4:
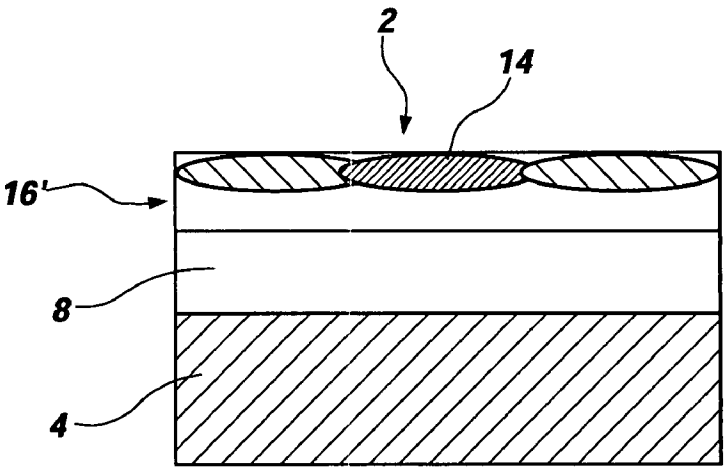
FIG. 4 is a schematic illustration of an embodiment of a fusible print medium having a fused layer.

At a temperature below the melting point of the solid plasticizer 12, such as a temperature observed during shipping or storage, the solid plasticizer 12 and the organic pigment 10 are present as discrete, spherical particles in the fusible print medium 2. The temperature used to fuse the fusible layer 6,6' may be selected based on the melting point of the solid plasticizer 12. The fusing temperature may be sufficiently higher than the melting point of the solid plasticizer 12, causing the solid plasticizer 12 to melt and coalesce. As the solid plasticizer 12 melts, it may contact and penetrate the organic pigment 10, causing the organic pigment 10 to soften. Once softened, the organic pigment 10 may melt and coalesce, forming a continuous film of the solid plasticizer 12 and the organic pigment 10. The continuous film may form a fused layer 16,16' on the fusible print medium 2, as shown in FIG. 3 (not drawn to scale) and FIG. 4 (not drawn to scale). The fused layer 16,16' may protect the printed image from damage and produce a high quality, photographic image. For instance, the fused layer 16,16' may protect the printed image from ozone or gas fade.

Fusing the fusible layer 6,6' may occur at a temperature above the melting point of the solid plasticizer but below a temperature at which the dye or pigment in the inkjet ink or other components in the fusible print medium 2 decompose, oxidize, or discolor. The temperature used to melt the fusible layer 6,6' may range from greater than approximately 40° C. to approximately 250° C. For instance, the temperature used to melt the fusible layer 6 may range from approximately 40° C. to 200° C.

The fusible print medium 2 may be exposed to the fusing conditions (heat, pressure, or a combination thereof) for an amount of time sufficient to fuse the fusible layer 6,6'. The amount of time used to fuse the fusible layer 6,6' may vary depending on the melting point of the solid plasticizer 12, the $T_g$ of the organic pigment, and the thickness of the fusible layer 6,6'. For instance, since the fusible layer 6' is thinner than the fusible layer 6, a shorter amount of time may be used to fuse the fusible layer 6' compared to the fusible layer 6. More complete fusing of the fusible layer 6,6' may also be achieved by exposing the fusible print medium 2 to a higher temperature and/or a higher pressure for an amount of time sufficient to completely fuse the fusible layer 6,6'. Alternatively, the fusible print medium 2 may be exposed to the fusing conditions for an amount of time sufficient to fuse at least a portion of the fusible layer 6,6'.

By including the solid plasticizer 12 in the fusible layer 6,6', the fusing efficiency of the fusible print medium 2 may be improved. Since the solid plasticizer 12 softens the organic pigment 10 and allows the organic pigment 10 to flow, a lower fusing temperature and/or a lower fusing pressure may be used to form the fused layer 16,16' compared to the fusing temperature and/or the fusing pressure used to fuse a fusible print medium lacking the solid plasticizer. In other words, the fusible print medium 2 may be exposed to a lower temperature and/or a lower pressure to fuse the fusible layer 6,6'. The lower temperature and/or pressure used to fuse the fusible layer 6,6' may correspond to a reduced amount of power that is produced by the heat source at a constant fusing throughput or to a higher throughput under the same fusing conditions.

In addition, shorter dwell times may be used to fuse the fusible layer 6,6', allowing the fusible print medium 2 to be used with high speed, inkjet printers. In other words, the fusible layer 6,6' may be fused in a reduced amount of time compared to the amount of time used to fuse a fusible layer lacking the solid plasticizer. Therefore, the fusing throughput of the fusible print media 2 at a constant power may be increased relative to the fusing throughput of a fusible layer lacking the solid plasticizer.

Since the fusing throughput of the fusible print medium 2 is increased or the amount of heat used to fuse the fusible print medium 2 is decreased, the fusing efficiency of the fusible print medium 2 may be improved. In addition, since the plasticizer is a solid at room temperature, the solid plasticizer 12 remains in the fusible layer 6,6' and does not migrate to other layers of the fusible print medium 2. Therefore, in contrast to liquid plasticizers, the solid plasticizer 12 remains in its desired location and maximizes the fusing efficiency of the fusible print medium 2.

The following describes examples of fusible print media 2 that include at least one organic pigment and at least one solid plasticizer. The examples are merely illustrative and are not meant to limit the scope of the present invention in any way.

EXAMPLES

Example 1

Preparation of a Dicyclohexyl Phthalate Dispersion in Water 28.17 g of dicyclohexyl phthalate (UNIPLEX 250, available from Unitex Chemical Corp.), 8.99 g of MOWIOL 20-98 (15.66% solution in water and available from Clariant Corp.), 1 g of SURFYNOL CT-110 (available from Air Products), 0.5 g of ACUMER 9300 (50% solid available from Rohm and Hass Company) and 62.26 g of deionized water were mixed with a lab stirrer until a homogeneous mixture was obtained. About 400 g of zirconium beads (0.4-0.6 mm from Union Process) were added to the mixture and stirred with a mechanical stirrer at a sufficient rate that the zirconium beads had good contact with the dicyclohexyl phthalate. The total grinding time was about eight hours. To collect the dispersion, the mixture of the dicyclohexyl phthalate and water was filtered through cheesecloth. The resulting dispersion had an average particle size of the dicyclohexyl phthalate of about 0.25 μm and the % solid was 9.92%.

Dispersions of other solid plasticizers, such as of UNIPLEX 280CG (sucrose benzoate) and UNIPLEX 250 (dicyclohexylphthalate), are dispersed in water in the same way to form stable dispersions.

Example 2

Preparation of Fusible Print Media

Fusible print media having fusible layers were prepared. The fusible layers included solid plastic pigments and UNIPLEX 250 as the solid plasticizer. Table 1 shows coating formulations of the fusible layers, expressed in parts, while Table 2 shows the amounts of each of the ingredients in each of the coating formulations.

TABLE 1

Coating Formulations of the Fusible Layer (expressed in parts)

| | Formulation | | | | | | | |
|---|---|---|---|---|---|---|---|---|
| Ingredients | I | II | III | IV | V | VI | VII | VIII |
| DOW 755 (parts) | 100 | 100 | 100 | 100 | | | | |
| DOW HS3000NA (parts) | | | | | 100 | 100 | 100 | 100 |
| CELVOL 523 (parts) | 10 | 10 | 10 | 10 | 10 | 10 | 10 | 10 |
| CURESAN 200 (parts) | 0.5 | 0.5 | 0.5 | 0.5 | 0.5 | 0.5 | 0.5 | 0.5 |
| UNIPLEX 250 (parts) | 0 | 5 | 10 | 15 | 0 | 5 | 10 | 15 |

TABLE 2

Coating Formulations of the Fusible Layer (expressed in grams)

| | | Formulation | | | | | | | |
|---|---|---|---|---|---|---|---|---|---|
| Ingredients | % Solid | I | II | III | IV | V | VI | VII | VIII |
| DOW 755 (grams) | 53.9 | 38.75 | 25.86 | 24.79 | 22.89 | | | | |
| DOW HS3000NA (grams) | 25.45 | | | | | 73.01 | 42.86 | 41.09 | 37.94 |
| CELVOL 523 (grams) | 10.95 | 18.52 | 12.73 | 12.2 | 11.27 | 16.91 | 9.96 | 9.55 | 8.82 |
| CURESAN 200 (grams) | 50 | 0.21 | 0.14 | 0.13 | 0.12 | 0.19 | 0.11 | 0.1 | 0.1 |
| UNIPLEX 250 (grams) | 9.92 | 0 | 7.03 | 13.47 | 24.87 | 0 | 5.5 | 10.54 | 19.47 |
| D.I. Water (grams) | 100 | 41.15 | 24 | 19.41 | 10.85 | 9.89 | 11.56 | 8.72 | 3.68 |
| % Solid | | 23 | 23 | 23 | 23 | 18 | 18 | 18 | 18 |

Fusible print media having fusible layers formed from each of Formulations I-VIII were prepared. The preparation of Formulation II is described in detail herein. In a 120-ml plastic beaker, 24 g of deionized water and 12.73 g of CELVOL 523 (10.95% solid) was mixed with a lab stirrer until a homogeneous solution was obtained. Then, 25.86 g of DOW 755 latex, 7.03 g of the UNIPLEX 250 dispersion (prepared as described in Example 1), and 0.14 g of CURESAN 200 were added, in order, to the stirred solution of CELVOL 523. The mixture was stirred for 30 minutes after the addition was completed.

The mixture of Formulation II was then applied to a coated paper (IKONO Gloss 200, manufactured by Zanders (Germany)) using a #36 MYLAR rod. Formulation II was coated onto the paper at a coatweight of 15 GSM. The coating of Formulation II was dried in a 50° C. oven for 10 minutes to provide a fusible print medium having a smooth, porous coating.

Formulations I and III-VIII were prepared in a similar manner to that described for Formulation II. Solutions of Formulations I, III, and IV were applied to the coated paper using a #36 MYLAR rod, while a #46 MYLAR rod was used to apply solutions of Formulations V-VIII.

Example 3

Fusing and Evaluation of the Fusible Print Media

Images were printed on each of the fusible print media described in Example 2 using an EPSON C80 inkjet printer. The images were allowed to dry overnight. The glossiness of each of the images was measured before fusing. Gloss is a measurement of surface smoothness and is used as an index for the efficiency of fusing. The higher the gloss of the image, the more complete the fusing of the fusible print medium. Gloss was measured at 60° C. with a GARDNER Model 4520 glossmeter, as known in the art.

To fuse the fusible print media, the images were passed through a fusing roller at a speed of 0.1 in/sec. The fusing roller had a surface temperature of 120° C. and provided 100 PSI of pressure. The gloss of the images after fusing was measured with the GARDNER Model 4520 glossmeter. The gloss data of the fusible print media before and after the fusing are shown in Table 3.

TABLE 3

Gloss of the Fusible Print Media Before and After Fusing.

| | % UNIPLEX 250 | Gloss of Fused Print Medium | Gloss of Unfused Print Medium |
|---|---|---|---|
| Formulation I | 0 | 28.7 | 15.4 |
| Formulation II | 5 | 38.9 | 18.4 |
| Formulation III | 10 | 48.9 | 17.6 |
| Formulation IV | 20 | 59.9 | 12.2 |
| Formulation V | 0 | 64.1 | 12.6 |
| Formulation VI | 5 | 74.5 | 13.6 |
| Formulation VII | 10 | 84.2 | 12 |
| Formulation VIII | 20 | 100.4 | 9.8 |

As shown in Table 3, the images printed on the fused print media had higher gloss than those printed on the unfused print media. In addition, the gloss of the images printed on the fused print media that included UNIPLEX 250 as the solid plasticizer had higher gloss than those printed on the control print media (Formulations I and V), which did not include the solid plasticizer. It was also observed that the gloss of the images increased with an increasing amount of solid plasticizer, regardless of whether non-hollow (DOW 755) or hollow (DOW HS-3000NA) plastic pigments were used in the fusible print medium.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A fusible print medium for use in inkjet printing, consisting of:

a substrate;

a fusible first ink-receiving layer; and, a second ink-receiving layer disposed between said first layer and said substrate, wherein said fusible first ink-receiving layer includes a mixture comprising:

a first plurality of discrete particles comprising at least one hollow organic pigment; and a second plurality of discrete particles comprising at least one solid plasticizer having a melting point between about 40° C. and about 150° C. and below a glass transition temperature of the at least one hollow organic pigment; and wherein said medium is formulated to form a fused surface layer approximately 0.2 μm to approximately 10 μm thick on said second ink-receiving layer on said substrate, when said medium is heated to a temperature above the melting point of said at least one plasticizer.

2. The fusible print medium of claim 1, wherein the at least one solid plasticizer has an average particle size of less than approximately 0.5 μm.

3. The fusible print medium of claim 1, wherein the at least one solid plasticizer is formulated to plasticize the at least one hollow organic pigment and is compatible with the at least one hollow organic pigment.

4. The fusible print medium of claim 1, wherein the at least one solid plasticizer has a melting point below about 90° C.

5. The fusible print medium of claim 1, wherein the at least one solid plasticizer has a molecular weight ranging from approximately 200 to approximately 2000.

6. The fusible print medium of claim 1, wherein the at least one solid plasticizer is selected from the group consisting of a phthalate compound, a terephthalate compound, an isophthalate compound, a benzoate compound, a polymeric adipate compound, a derivative of p-toluenesulfonamide, an isomer of terphenyl, and mixtures thereof.

7. The fusible print medium of claim 1, wherein the at least one solid plasticizer is selected from the group consisting of sucrose benzoate, 1,4-cyclohexanedmethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, o,p-toluenesulfonamide, N-cyclohexyl-p-toluenesulfonamide, 1,2-di-(3-methylphenoxy)ethane, and mixtures thereof.

8. The fusible print medium of claim 1, wherein the plurality of discrete particles further comprises at least one solid plastic pigment.

9. The fusible print medium of claim 8, wherein the at least one solid plastic pigment is selected from the group consisting of acrylic, styrene acrylic, ethylene vinylacetate, vinyl-acrylate, styrene, polyurethane, polyester, low density polyethylene beads, polystyrene beads, polymethylmethacrylate beads, and polyester particles.

10. The fusible print medium of claim 1, wherein the at least one hollow organic pigment comprises an average particle size ranging from approximately 0.2 μm to approximately 10 μm.

11. The fusible print medium of claim 1, wherein the at least one hollow organic pigment has a void volume ranging from approximately 10% to approximately 90%.

12. The fusible print medium of claim 1, wherein the at least one hollow organic pigment comprises an acrylic polymer or a styrene acrylic polymer.

13. The fusible print medium of claim 1, wherein the at least one solid plasticizer has an average particle size of less than approximately 5 μm.

14. The fusible print medium of claim 1, wherein the fusible layer has a coatweight ranging from approximately 10 grams per square meter ("GSM") to approximately 50 GSM.

15. The fusible print medium of claim 1, wherein the plurality of discrete particles further comprises at least one solid organic pigment comprising at least one synthetic latex selected from the group consisting of an acrylic, styrene acrylic, ethylene vinylacetate, vinyl-acrylate, styrene, polyurethane, and polyester.

16. The fusible print medium of claim 1, wherein the at least one hollow organic pigment has an average particle size ranging from approximately 0.05 μm to approximately 0.3 μm.

17. The fusible print medium of claim 1, wherein the at least one solid plasticizer has an average particle size of less than approximately 1 μm.

18. The fusible print medium of claim 1, wherein the fusible layer has a coatweight ranging from approximately 0.2 GSM to approximately 10 GSM.

19. The fusible print medium of claim 1, wherein the fusible layer comprises from approximately 50 weight percent to approximately 95 weight percent of the at least one hollow organic pigment, from approximately 2 weight percent to approximately 20 weight percent of a dispersion of the at least one solid plasticizer, and from approximately 1 weight percent to approximately 20 weight percent of at least one binder.

20. The medium of claim 1, wherein said mixture further comprises at least one binder having a Tg lower than approximately 30° C.

21. A method of producing a fusible print medium, consisting of:

forming a second ink-receiving layer on a substrate; and depositing a particle mixture on said second ink-receiving layer, wherein said particle mixture comprises a first plurality of discrete particles comprising at least one hollow organic pigment, and a second plurality of discrete particles comprising at least one solid plasticizer having a melting point between about between about 40° C. and about 150° C. and below a glass transition temperature of the at least one hollow organic pigment; and forming from said deposited mixture a fusible first ink-receiving layer having a thickness ranging from approximately 0.2 μm to approximately 10 μm on said second ink-receiving layer, to provide a fusible print medium configured for receiving an ink-jet printed image and for forming a glossy fused print medium comprising said substrate and containing said image.

22. The method of claim 21, wherein forming said mixture comprises causing the at least one solid plasticizer to have an average particle size of less than about 0.5 μm.

23. The method of claim 21, wherein forming said mixture comprises selecting at least one solid plasticizer having a melting point below about 90° C.,and wherein said forming from said deposited mixture a fusible first ink-receiving layer comprises heating said deposited mixture to a temperature between said melting point and 90° C.

24. The method of claim 21, wherein in forming said mixture, the at least one solid plasticizer has a molecular weight ranging from approximately 200 to approximately 2000 on the substrate.

25. The method of claim 21, wherein in forming said mixture, the at least one solid plasticizer is selected from the group consisting of a phthalate compound, a terephthalate compound, an isophthalate compound, a benzoate compound, a polymeric adipate compound, a derivative of p-toluenesulfonamide, an isomer of terphenyl, and mixtures thereof on the substrate.

26. The method of claim 21, wherein in forming said mixture, the at least one solid plasticizer is selected from the group consisting of sucrose benzoate, 1,4-cyclohexanedmethanol dibenzoate, glyceryl tribenzoate, dicyclohexyl phthalate, benzyl 2-naphthyl ether, dimethyl terephthalate, 2-chloropropionanilide, 4-benzyldiphenyl, dibenzyl oxalate, m-terphenyl, diphenyl phthalate, diphenyl isophthalate, o,p-toluenesulfonamide, N-cyclohexyl-p-toluenesulfonamide, 1,2-di-(3-methylphenoxy)ethane, and mixtures thereof on the substrate.

27. The method of claim 21, wherein in forming said mixture, said first plurality of discrete particles further comprise at least one solid plastic pigment.

28. The method of claim 27, wherein in forming said mixture, said first plurality of discrete particles further comprises at least one solid organic pigment comprising at least one synthetic latex selected from the group consisting of an acrylic, styrene acrylic, ethylene vinylacetate, vinyl-acrylate, styrene, polyurethane, and polyester.

29. The method of claim 27, wherein in forming said mixture, the at least one solid organic pigment has an average particle size ranging from approximately 0.05 μm to approximately 0.3 μm.

30. The method of claim 27, wherein in forming said mixture, the at least one solid plasticizer has an average particle size of less than approximately 1 μm.

31. The method of claim 21, wherein in forming said mixture, said at least one solid plastic pigment is selected from the group consisting of an acrylic, styrene acrylic, ethylene vinylacetate, vinyl-acrylate, styrene, polyurethane, polyester, low density polyethylene beads, polystyrene beads, polymethylmethacrylate beads, and polyester particles.

32. The method of claim 21, wherein in forming said mixture, said at least one hollow organic pigment has an average particle size ranging from approximately 0.2 μm to approximately 10 μm.

33. The method of claim 21, wherein in forming said mixture, said at least one hollow organic pigment has a void volume ranging from approximately 10% to approximately 90%.

34. The method of claim 21, wherein in forming said mixture, the at least one hollow organic pigment is an acrylic polymer or a styrene acrylic polymer.

35. The method of claim 21, wherein in forming said mixture, the at least one solid plasticizer has an average particle size of less than approximately 5 μm on the substrate.

36. The method of claim 21, wherein in forming said fusible first ink-receiving layer on the second ink-receiving layer, the resulting layer has a coatweight ranging from approximately 10 grams per square meter ("GSM") to approximately 50 GSM.

37. The method of claim 21, wherein in forming a fusible first ink-receiving layer on the second ink-receiving layer, the resulting fusible layer has a coatweight ranging from approximately 0.2 GSM to approximately 10 GSM.

38. The method of claim 21, wherein forming said fusible first ink-receiving layer on the second ink-receiving surface comprises forming the fusible layer comprising from approximately 50 weight percent to approximately 95 weight percent of the at least one hollow organic pigment, from approximately 2 weight percent to approximately 20 weight percent of a dispersion of the at least one solid plasticizer, and from approximately 1 weight percent to approximately 20 weight percent of at least one binder.

39. The method of claim 21 wherein in forming said mixture, at least one binder is combined with said first and second pluralities of discrete particles, wherein said binder has a Tg lower than approximately 30° C.

40. A fusible print medium for use in inkjet printing, consisting of:

a substrate;

a fusible first ink-receiving layer; and, a second ink-receiving layer disposed between said first layer and said substrate, wherein said second ink-receiving layer comprises microporous inorganic particles and a binder, said fusible first ink-receiving layer including a mixture comprising:

a first plurality of discrete particles comprising at least one hollow organic pigment; and a second plurality of discrete particles comprising at least one solid plasticizer having a melting point between about 40° C. and about 150° C. and below a glass transition temperature of the at least one hollow organic pigment; and wherein said medium is formulated to form a fused surface layer approximately 0.2 μm to approximately 10 μm thick on said second ink-receiving layer on said substrate, when said medium is heated to a temperature above the melting point of said at least one plasticizer.

* * * * *

UNITED STATES PATENT AND TRADEMARK OFFICE

CERTIFICATE OF CORRECTION

PATENT NO. : 7,651,747 B2
APPLICATION NO. : 10/925232
DATED : January 26, 2010
INVENTOR(S) : Tienteh Chen et al.

It is certified that error appears in the above-identified patent and that said Letters Patent is hereby corrected as shown below:

In column 11, line 61, in Claim 7, delete "cyclohexanedmethanol" and insert -- cyclohexanedimethanol --, therefor.

In column 12, line 50, in Claim 20, delete "Tg" and insert -- $T_g$ --, therefor.

In column 12, line 62, in Claim 21, after "between about" delete "between about".

In column 13, lines 29-30, in Claim 26, delete "cyclohexanedmethanol" and insert -- cyclohexanedimethanol --, therefor.

In column 14, line 35, in Claim 39, delete "Tg" and insert -- $T_g$ --, therefor.

Signed and Sealed this

Twenty-ninth Day of June, 2010

David J. Kappos

David J. Kappos
*Director of the United States Patent and Trademark Office*